US008087104B2

(12) United States Patent
Reynolds

(10) Patent No.: US 8,087,104 B2
(45) Date of Patent: Jan. 3, 2012

(54) MANUAL TOILET SEAT LIFTER APPARATUS

(76) Inventor: James W. Reynolds, Bryn Mawr, PA (US)

( * ) Notice: Subject to any disclaimer, the term of this patent is extended or adjusted under 35 U.S.C. 154(b) by 449 days.

(21) Appl. No.: 12/380,542

(22) Filed: Mar. 2, 2009

(65) Prior Publication Data

US 2010/0218307 A1 Sep. 2, 2010

(51) Int. Cl.
*A47K 13/10* (2006.01)

(52) U.S. Cl. ..... 4/246.1

(58) Field of Classification Search ..... 4/246.1, 4/246.3–246.5

See application file for complete search history.

(56) References Cited

U.S. PATENT DOCUMENTS 4,951,324 A * 8/1990 Lirette ..... 4/246.1
D341,765 S * 11/1993 Thomas ..... D8/307
5,461,733 A * 10/1995 McKee ..... 4/246.1

* cited by examiner

*Primary Examiner* — Charles Phillips

(57) ABSTRACT

A manual toilet seat lifter apparatus is provided for lifting and lowering a toilet seat and includes strap hinge members connected to the toilet seat. A hinge pin is received in the strap hinge members. A riser rod is connected to the hinge pin. A handle is connected to a top end of the riser rod, and a counterweight is connected to a bottom end of the riser rod. Preferably, a horizontal transition portion is connected between the hinge pin and the riser rod. Preferably, a horizontal extension portion is connected to the riser rod at a location on the riser rod which is opposite to the horizontal transition portion. With a second embodiment of the invention, which is a combined toilet seat lifter and toilet seat cover lifter apparatus, toilet seat cover lifting means are provided for lifting and lowering a toilet seat cover.

6 Claims, 4 Drawing Sheets

FIG 1
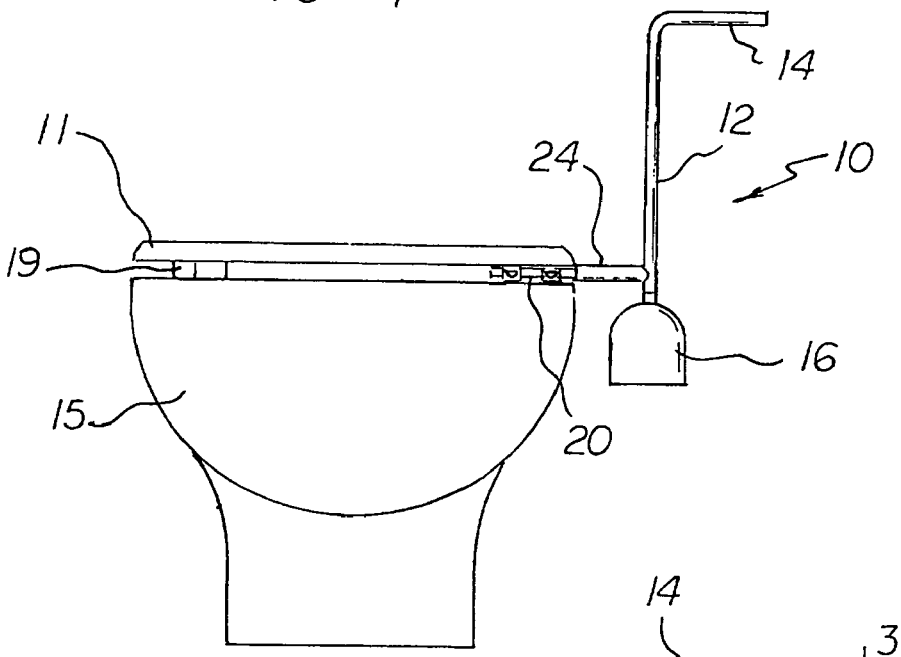
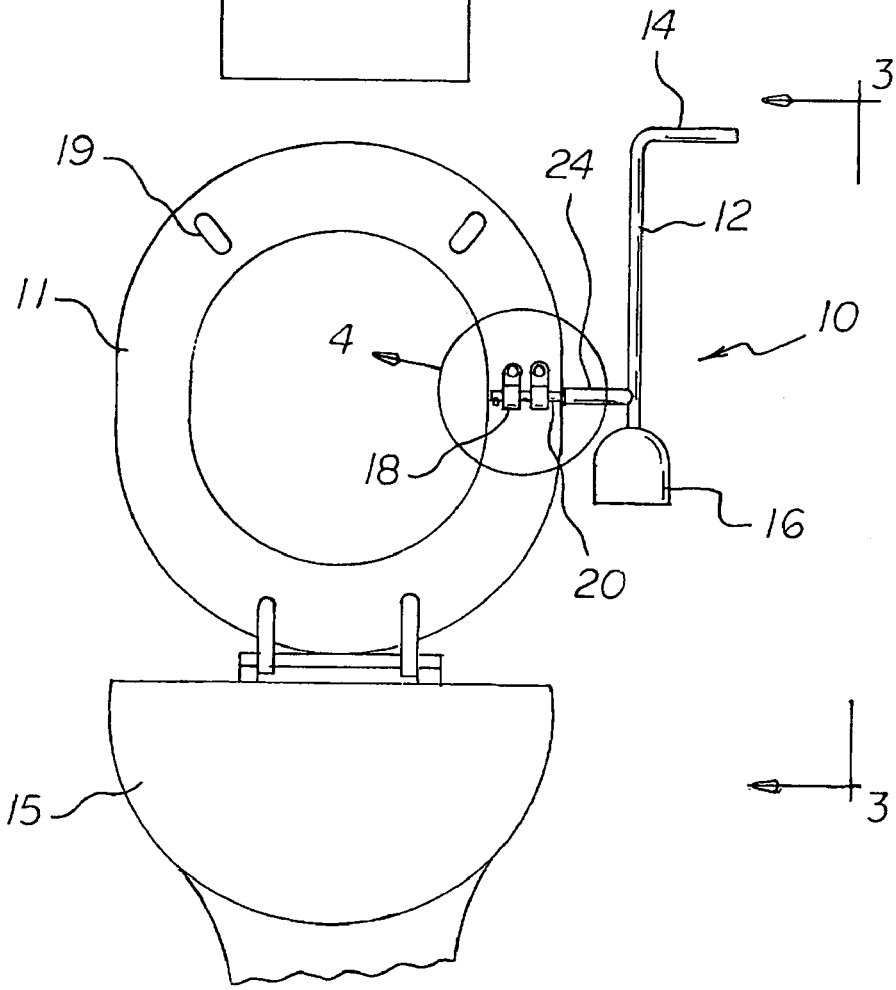
FIG 2

FIG 3
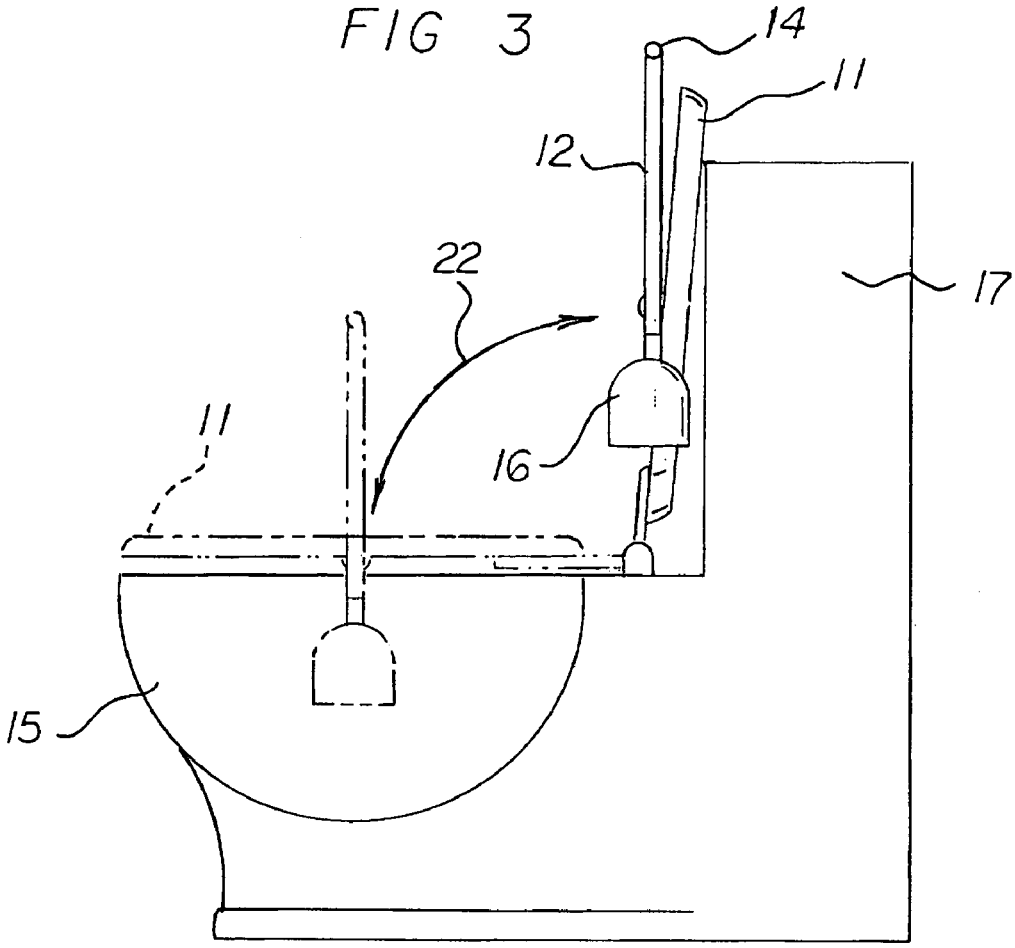
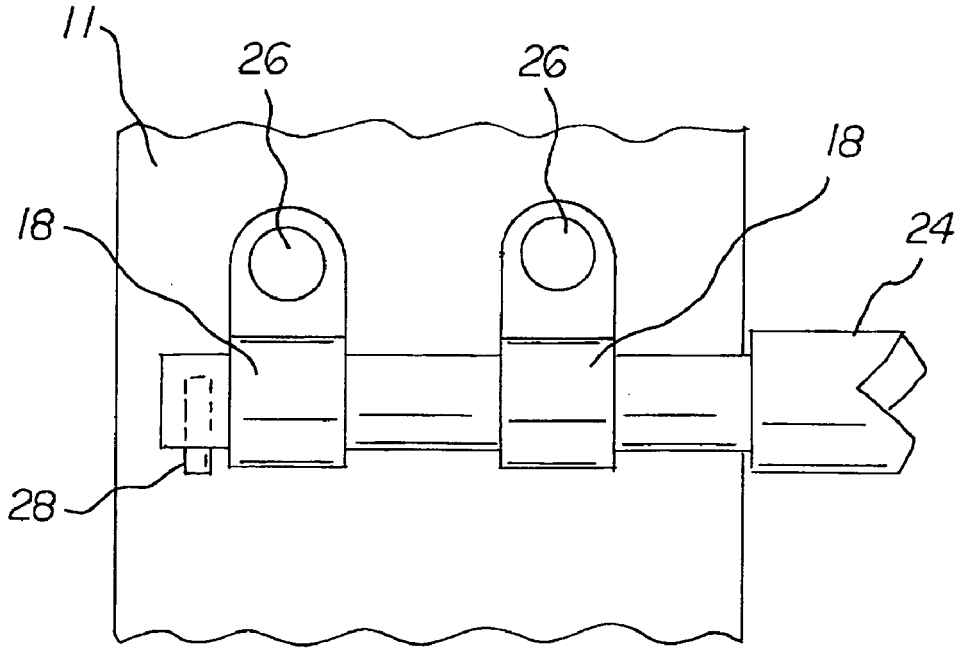
FIG 4

FIG 7
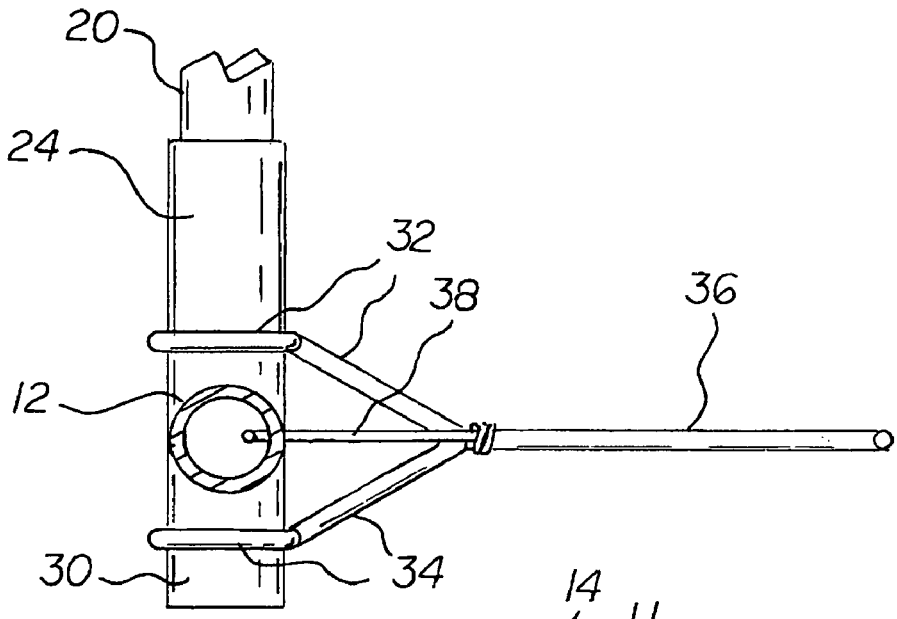
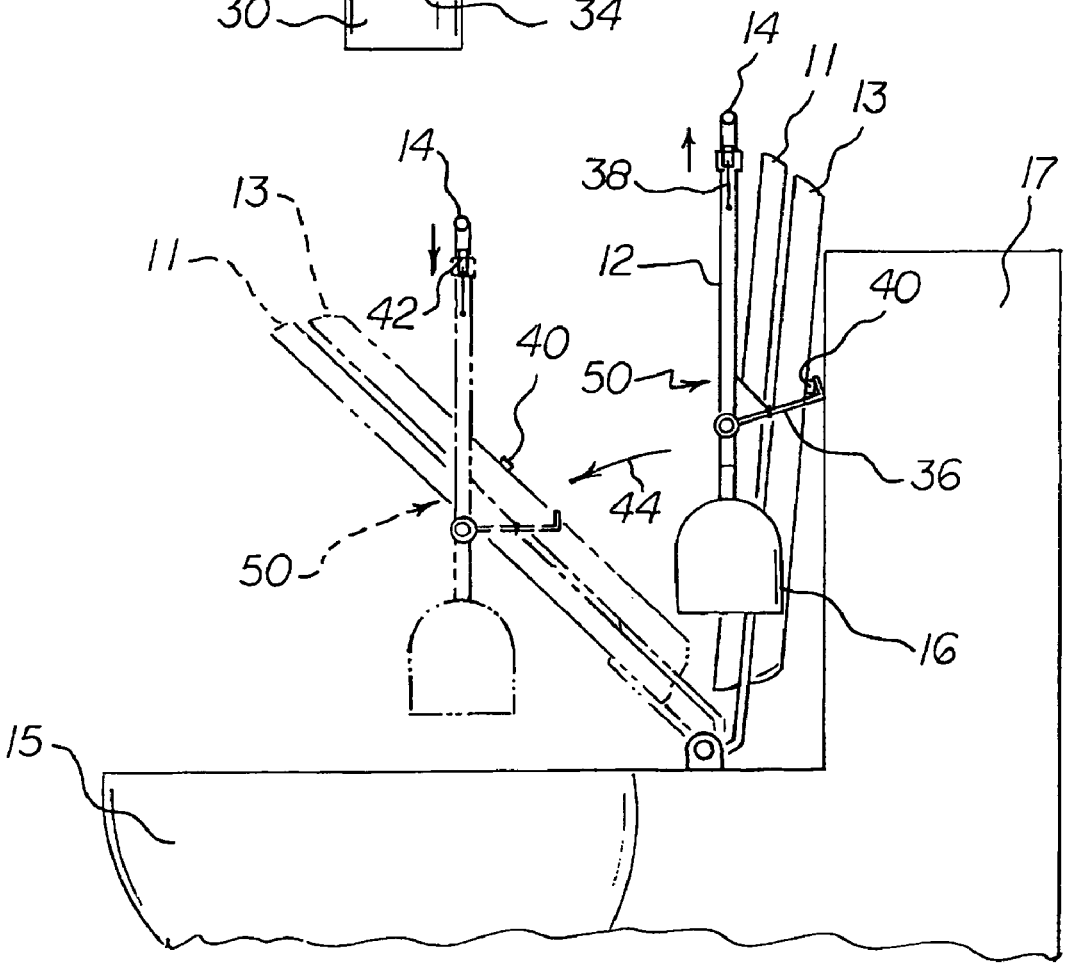
FIG 8

MANUAL TOILET SEAT LIFTER APPARATUS

BACKGROUND OF THE INVENTION

1. Field of the Invention

The present invention relates generally to toilet seat lifters, and, more particularly, to toilet seat lifters especially adapted to be lifted manually.

2. Description of the Prior Art

Because toilet seats can become dirty quickly, throughout the years a number of devices have been invented by which a person does not need to manually touch a toilet seat in order to lift it. Some such toilet seat lifters allow a person to press a foot pedal, and thereby lift a toilet seat. Other known toilet seat lifters allow a person to operate some sort of manually operated means without manually touching the toilet seat itself.

In this respect, throughout the years, a number of innovations have been developed relating to manually-operated toilet seat lifters which permit the user to lift a toilet seat without touching the toilet seat itself, and the following U.S. patents are representative of some of those innovations: U.S. Pat. Nos. 1,999,555, 2,236,576, 3,935,601, 5,058,215, and 5,729,839.

More specifically, each of U.S. Pat. Nos. 1,999,555, 2,236,576, 3,935,601, 5,058,215, and 5,729,839 discloses a toilet seat lifter handle that is attached to the toilet seat at a very close location to the toilet seat. As a result, if an off-target urine stream accidently falls upon the toilet seat, there is a strong likelihood that the off-target urine stream would also contact the toilet seat lifter handle that is located close to the toilet seat itself. In this respect, it would be desirable if a manually-operated toilet seat lifter were provided which had a handle portion that is remotely located from the toilet seat itself.

In addition, each of the toilet seat lifters provided in U.S. Pat. Nos. 1,999,555, 3,935,601, and 5,058,215 has a handle attached to the toilet seat in a fixed orientation. As a result, when the toilet seat is lifted and, thereby, the orientation of handle is changed, it becomes more difficult for a user to maintain a firm grip on the handle. In this respect, it would be desirable if a toilet seat lifter were provided whereby the orientation of the handle remains in a horizontal orientation even as the toilet seat is lifted.

Among the patents discussed hereinabove, only U.S. Pat. No. 5,729,839 discloses an additional manually-operated handle for lifting a toilet seat cover. However, this patent requires that two separate and distinct handles be provided, a first handle for lifting the toilet seat and a second handle for lifting the toilet seat cover. Rather than having two separate and distinct manually-operated handles for lifting the toilet seat and the toilet seat cover, it would be desirable if a device were provided which has a single manually-operated handle that can be used for lifting both the toilet seat and the toilet seat cover.

Thus, while the foregoing body of prior art indicates it to be well known to use a manually-operated toilet seat lifter apparatus, the prior art described above does not teach or suggest a manual toilet seat lifter apparatus which has the following combination of desirable features: (1) has a handle portion that is remotely located from the toilet seat itself; (2) provides that the orientation of the handle remains in an upright yet horizontal orientation even as the toilet seat is lifted; and (3) has a single manually-operated handle that can be used for lifting both the toilet seat and the toilet seat cover. The foregoing desired characteristics are provided by the unique manual toilet seat lifter apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a manual toilet seat lifter apparatus for lifting and lowering a toilet seat and includes first toilet seat hinge means connected to the toilet seat. Second toilet seat hinge means are received in the first toilet seat hinge means. A riser rod is connected to the second toilet seat hinge means. A handle is connected to a top end of the riser rod, and a counterweight is connected to a bottom end of the riser rod.

Preferably, the first toilet seat hinge means include strap hinges, and the second toilet seat hinge means include a hinge pin received in the strap hinges.

Preferably, a lock pin is connected to the hinge pin, for preventing the hinge pin from slipping out from the strap hinges.

Preferably, a horizontal transition portion is connected between the hinge pin and the riser rod.

Preferably, a horizontal extension portion is connected to the riser rod at a location on the riser rod which is opposite to the horizontal transition portion.

With a second embodiment of the invention, a combined toilet seat lifter and toilet seat cover lifter apparatus, toilet seat cover lifting means are provided for lifting and lowering a toilet seat cover. The toilet seat cover lifting means include first toilet seat cover lifting means which are connected to the horizontal transition portion, the horizontal extension portion, and the riser rod. In addition, the toilet seat cover lifting means include second toilet seat cover lifting means which are connected to the toilet seat cover itself.

Preferably, the first toilet seat cover lifting means include a first hinge member which is connected to the horizontal transition portion. A second hinge member is connected to the horizontal extension portion. A hook portion is connected to the first hinge member and the second hinge member. A hook control member is connected to the hook portion. A hook actuator handle, supported by the riser rod, is connected to the hook control member.

The hook control member is preferably a stiff wire which is interconnected between the hook portion and the hook actuator handle.

The second toilet seat cover lifting means include a horizontally oriented hookable finger which is connected to the toilet seat cover.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved manual toilet seat lifter apparatus which has all of the advantages of the prior art and none of the disadvantages.

It is another object of the present invention to provide a new and improved manual toilet seat lifter apparatus which may be easily and efficiently manufactured and marketed.

It is a further object of the present invention to provide a new and improved manual toilet seat lifter apparatus which is of durable and reliable construction.

An even further object of the present invention is to provide a new and improved manual toilet seat lifter apparatus which is susceptible of a low cost of manufacture with regard to both materials and labor, and which accordingly is then susceptible of low prices of sale to the consuming public, thereby making such manual toilet seat lifter apparatus available to the buying public.

Still yet a further object of the present invention is to provide a new and improved manual toilet seat lifter apparatus which has a handle portion that is remotely located from the toilet seat itself.

Still another object of the present invention is to provide a new and improved manual toilet seat lifter apparatus that provides that the orientation of the handle remains in an upright yet horizontal orientation even as the toilet seat is lifted.

Yet another object of the present invention is to provide a new and improved manual toilet seat and toilet bowl cover lifter apparatus which has a single manually-operated handle that can be used for lifting both the toilet seat and the toilet seat cover.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a front view showing a first embodiment of the manual toilet seat lifter apparatus of the invention, wherein a toilet seat is in a lowered position.

FIG. 2 is a front view showing the first embodiment of the manual toilet seat lifter apparatus of the invention, wherein the toilet seat is in a raised position.

FIG. 3 is a side view of the embodiment of the manual toilet seat lifter apparatus shown in FIG. 2 taken along line 3-3 of FIG. 2.

FIG. 4 an enlarged view of a portion of the invention shown in FIG. 2, taken in encircled region 4 of FIG. 2.

FIG. 7 is an enlarged, partial cross-sectional view of the embodiment of the invention shown in FIG. 6, taken along line 7-7 thereof.

FIG. 8 is a side view of the embodiment of the manual toilet seat and toilet bowl cover lifter apparatus of the invention shown in FIG. 6, wherein both the toilet seat and the toilet seat cover are shown being lowered together from the lifted orientation to the horizontal orientation.

DESCRIPTION OF THE PREFERRED EMBODIMENT

Figure 5:
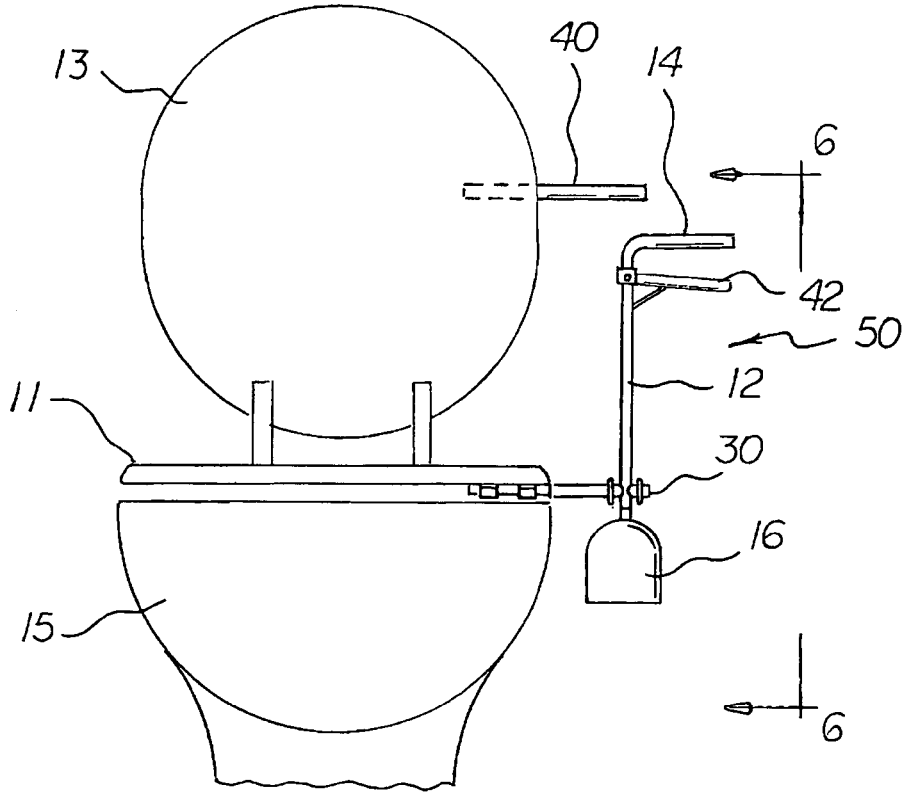
FIG. 5 is a front view of a second embodiment of the manual toilet seat lifter apparatus of the invention, that is a combined toilet seat lifter and toilet seat cover lifter apparatus, wherein means are provided for lifting the toilet seat cover as well as the toilet seat, and wherein the toilet seat cover is already in a lifted position.

With reference to the drawings, a new and improved manual toilet seat lifter apparatus embodying the principles and concepts of the present invention will be described.

Turning to FIGS. 1-4, there is shown a first embodiment of the manual toilet seat lifter apparatus of the invention generally designated by reference numeral 10. In each of the figures, reference numerals are shown that correspond to like reference numerals that designate like elements shown in other figures.

In the first embodiment, a manual toilet seat lifter apparatus 10 is provided for lifting and lowering a toilet seat 11 and includes first toilet seat hinge means connected to the toilet seat 11. Second toilet seat hinge means are received in the first toilet seat hinge means. A riser rod 12 is connected to the second toilet seat hinge means. A handle 14 is connected to a top end of the riser rod 12, and a counterweight 16 is connected to a bottom end of the riser rod 12.

Preferably, the first toilet seat hinge means include strap hinges 18, and the second toilet seat hinge means include a hinge pin 20 received in the strap hinges 18.

Preferably, a lock pin 28 is connected to the hinge pin 20, for preventing the hinge pin 20 from slipping out from the strap hinges 18. A hole can be drilled into the hinge pin 20 to accommodate reception of the lock pin 28.

Preferably, a horizontal transition portion 24 is connected between the hinge pin 20 and the riser rod 12.

To install the first embodiment of the invention onto a toilet seat 11, a pair of strap hinges 18, such as shown in FIGS. 1-4, can be attached to the bottom of the toilet seat 11 using screws 26. The pair of strap hinges 18 are placed in alignment so that they both receive the hinge pin 20 to form the complete hinge.

The toilet seat 11 and the manual toilet seat lifter apparatus 10 are shown in a lowered position in FIG. 1 with solid lines. In FIG. 3, the lowered position of the toilet seat 11 and the manual toilet seat lifter apparatus 10 of the invention are shown in broken lines.

If the toilet seat cover 13 has already been lifted (such as shown in 5 or 6 infra, for example) to lift the toilet seat 11 from the lowered position to the lifted position, as shown in solid lines in FIG. 3, a user (not shown) grasps the handle 14 and lifts the handle 14 upward. As this is done, the toilet seat 11 and manual toilet seat lifter apparatus 10 move toward the lifted position shown in solid lines and as indicated by the right portion of directional arrow 22.

As the toilet seat 11 and the manual toilet seat lifter apparatus 10 are raised and moved toward the lifted position, the handle 14 is raised up, and the hinge pin 20 rotates within the strap hinges 18. In addition, the counterweight 16 helps maintain the orientation of the riser rod 12 in a vertical orientation as the toilet seat 11 and the manual toilet seat lifter apparatus 10 are lifted.

It is noted here that the operation of the manual toilet seat lifter apparatus is the same, even if the toilet seat cover 13 had not already been lifted. In such a case, when the manual toilet seat lifter apparatus 10 is lifted, both the toilet seat 11 and the toilet seat cover 13 are lifted simultaneously.

To lower the lifted toilet seat 11 to the lowered position, as indicated by the left portion of the directional arrow 22, the user grasps the handle 14 and pulls the handle toward the front of the toilet bowl 15. As this is done, the hinge pin 20 rotates within the strap hinges 18, and the counterweight 16 helps keep the riser rod 12 in a vertical orientation. After the toilet seat 11 is in the lowered or horizontal orientation, the counterweight 16 causes the riser rod 12 to remain in the vertical orientation.

With the first embodiment of manual toilet seat lifter apparatus 10, as shown in FIGS. 1-4, once the toilet seat cover 13 has been lifted, the toilet seat cover 13 cannot be lowered by operation of the manual toilet seat lifter apparatus 10.

Turning to FIGS. 5-8, a second embodiment of the invention is shown in which a combined toilet seat lifter and toilet seat cover lifter 50 is provided. The manual toilet seat lifter portion and the manual toilet seat cover lifter portion of the combined toilet seat lifter and toilet seat cover lifter 50 have common strap hinges 18, a common hinge pin 20, a common horizontal transition portion 24, a common riser rod 12, and a common handle 14. Generally, reference numerals are shown that correspond to like reference numerals that designate like elements shown in the other figures. In addition, a horizontal extension portion 30 is connected to the riser rod 12 at a location on the riser rod 12 which is opposite to the horizontal transition portion 24.

Toilet seat cover lifting means are provided for lifting and lowering a toilet seat cover 13. The toilet seat cover lifting means include first toilet seat cover lifting means which are connected to the horizontal transition portion 24, the horizontal extension portion 30, and the riser rod 12. In addition, the toilet seat cover lifting means include second toilet seat cover lifting means which are connected to the toilet seat cover 13 itself.

Preferably, the first toilet seat cover lifting means include a first hinge member 32 which is connected to the horizontal transition portion 24. A second hinge member 34 is connected to the horizontal extension portion 30. A hook portion 36 is connected to the first hinge member 32 and the second hinge member 34. A hook control member 38 is connected to the hook portion 36. A hook actuator handle 42, supported by the riser rod 12, is connected to the hook control member 38.

The first hinge member 32 can include a ring portion that fits onto the horizontal transition portion 24, and the second hinge member 34 can include a ring portion that fits onto the horizontal extension portion 30. The ring portion of the first hinge member 32 pivots freely on the horizontal transition portion 24, and the ring portion of the second hinge member 34 pivots freely on the horizontal extension portion 30. The two ring portions can be separated from each other by 2 inches. The two ring portions can have a diameter of approximately 0.5 inch. Each of the first hinge member 32 and the second hinge member 34 can have a respective arm portion, and the respective arm portions converge into a Y-shape that meets at the hook portion 36. The hook portion 36 can be 3 inches long. The hook control member 38 is preferably a stiff wire which is interconnected between the hook portion 36 and the hook actuator handle 42.

The second toilet seat cover lifting means include a horizontally oriented hookable finger 40 which is connected to the toilet seat cover 13. The hookable finger 40 can be made of a solid material, such as wood, and can extend 2 inches beyond the perimeter of the toilet seat cover 13 so that it can be hooked by the hook portion 36 when the hook portion 36 is actuated.

Operation of the combined toilet seat lifter and toilet seat cover lifter apparatus 50 of the invention is considered in relation to three different starting conditions.

Figure 6:
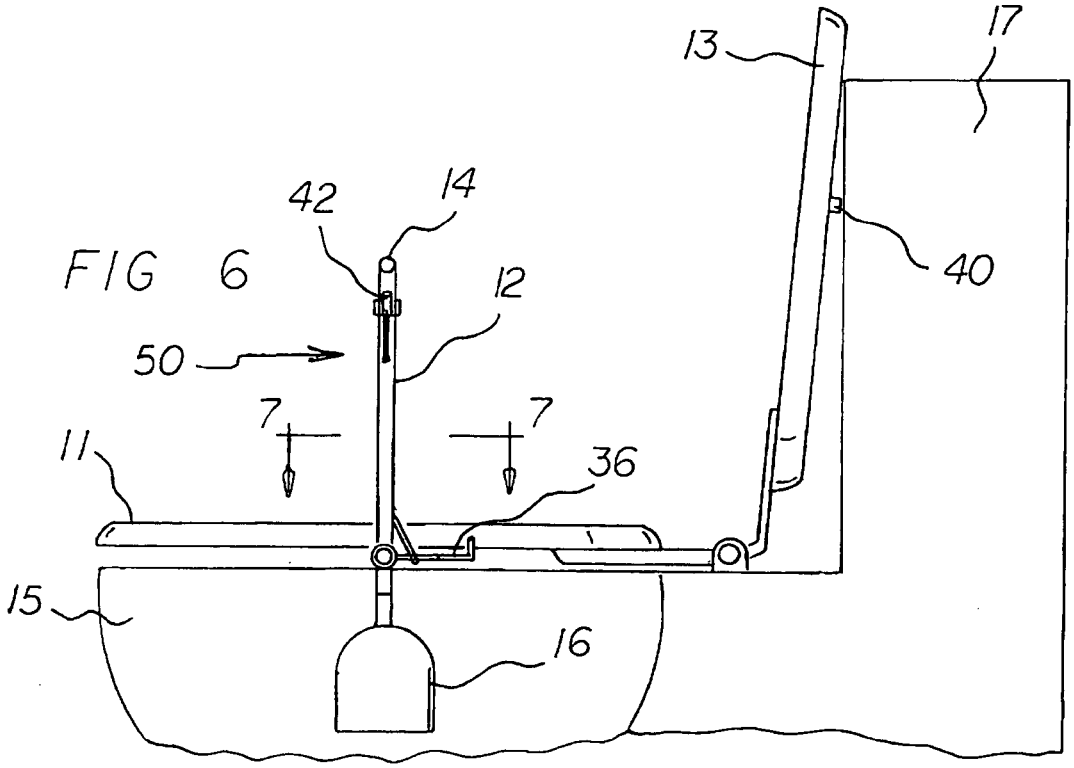
FIG. 6 is a side view of the embodiment of the manual toilet seat and toilet bowl cover lifter apparatus of the invention shown in FIG. 5, taken along line 6-6 thereof.

With the first starting condition, shown in FIGS. 5 and 6, the toilet seat cover 13 had already been lifted to the lifted state, and the toilet seat 11 is in the lowered condition. With this first starting condition, operation of the combined toilet seat lifter and toilet seat cover lifter apparatus 50 is the same as the first embodiment of the manual toilet seat lifter apparatus 10 discussed in relation to FIGS. 1-4.

With the second starting condition, not specifically shown in the drawings, both the toilet seat 11 and the toilet seat cover 13 are in the lowered condition. Then, to raise both the toilet seat 11 and the toilet seat cover 13 simultaneously to the lifted condition, the handle 14 is lifted and both the toilet seat 11 and the toilet seat cover 13 are pulled up simultaneously.

The third starting condition is shown in FIG. 8 in which both the toilet seat 11 and the toilet seat cover 13 are shown in solid lines, in the lifted condition. From the third starting condition, two different options are contemplated.

With the first option of the third starting condition, shown in FIG. 6, only the toilet seat 11 is brought to the lowered condition, and the toilet seat cover 13 is left in the lifted condition. Carrying out this first option is similar to lowering a lifted toilet seat 11, with the first embodiment of the manual toilet seat lifter apparatus 10. That is, the handle 14 is grasped by a user and pulled away from the lifted toilet seat cover 13. When this occurs, the toilet seat 11 is lowered, and the toilet seat cover 13 remains in the lifted condition.

With the second option of the third starting condition, both the toilet seat 11 and the toilet seat cover 13 are to be lowered simultaneously by the combined toilet seat lifter and toilet seat cover lifter apparatus 50. With reference to FIG. 8, a user grasps both the handle 14 and squeezes the hook actuator handle 42 upward. When this is done, the hook actuator handle 42 pulls up on the hook control member 38 and, thereby, pulls the hook portion 36 upward. Then, the user pulls on the handle 14 and the hook actuator handle 42 in a direction away from the toilet tank 17. As a result, the lifted hook portion 36 engages the hookable finger 40 on the toilet seat cover 13 and pulls the toilet seat cover 13 along with the toilet seat 11 as both the toilet seat 11 and the toilet seat cover 13 are lowered simultaneously, as shown by directional arrow 44. Both the toilet seat 11 and the toilet seat cover 13 are lowered simultaneously as shown in broken lines in FIG. 8.

If the hook actuator handle 42 is not squeezed toward the handle 14, the hook control member 38 is not pulled, and the hook portion 36 is not lifted to engage the hookable finger 40 on the toilet seat cover 13.

Although the specification of dimensions of various components of the invention can be selected as desired, the following specifications may be employed. The riser rod 12 can be a vertical hollow tube 10 inches long, and 0.5 inch in diameter. The upper end of the riser rod 12 is connected horizontally to the handle 14 which can be a 4 inch tube of similar diameter. At about 1 inch from the bottom end of the riser rod 12, the horizontal transition portion 24 can be is connected to the riser rod 12. The horizontal transition portion 24 can be another tube 2.25 inches long. The hinge pin 20 can be 2.25 inches long and can have a diameter of 0.375 inch. The entire structure just described, can either be molded as a single entity or joined together by connectors.

The strap hinges 18 can be two 0.375 inch Nylon Cable clamps fitted with screws 26 that are used to attach the hinge pin 20 to the under-surface of the toilet seat 11. When the hinge pin 20 is attached to the undersurface of the toilet seat 11, the fit will be loose enough to allow the entire assembly to pivot in place.

The counterweight 16 can be a small weighted container that is firmly attached to the bottom of the riser rod 12. The counterweight 16 serves as a counterbalancing weight keeping the manual toilet seat lifter apparatus 10 upright at all times. For toilets that lack the proper clearance between the lowered toilet seat 11 and the top of the toilet bowl 15, to accommodate the 0.375 inch lower arm of the toilet seat lifter, two 1.5 inch long by 0.25 inch wide by 0.5 inch high wedges (not shown) can be employed. These wedges can be treated with an adhesive along one of the 1.5 inch surfaces so that they can be used to replace the original factory installed toilet seat supports 19.

The components of the manual toilet seat and toilet bowl cover lifter apparatus of the invention and the combined toilet seat lifter and toilet seat cover lifter apparatus can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved manual toilet seat lifter apparatus that is low in cost, relatively simple in design and operation, and which advantageously has a handle portion that is remotely located from the toilet seat itself. With the invention, a manual toilet seat lifter apparatus provides that the orientation of the handle remains in an upright yet horizontal orientation even as the toilet seat is lifted. With the invention, a combined toilet seat lifter and toilet seat cover lifter apparatus is provided which has a single manually-operated handle that can be used for lifting both the toilet seat and the toilet seat cover.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use. For example, if desired, a small splatter shield (not shown) or guard, suitably may be attached to the riser rod 12 extending transversely (horizontally) from the axis thereof and between the handle 14 and the horizontal transition portion 24 to further protect the handle 14 from splash.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A manual toilet seat lifter apparatus for lifting and lowering a toilet seat, comprising:

first toilet seat hinge means connected to the toilet seat, second toilet seat hinge means received in said first toilet seat hinge means, a riser rod connected to said second toilet seat hinge means, a handle connected to a top end of said riser rod, a counterweight connected to a bottom end of said riser rod, a horizontal extension portion connected to said riser rod at a location on said riser rod which is opposite to said horizontal transition portion, a toilet seat cover lifting means for a toilet seat cover, wherein said toilet seat cover lifting means includes a first toilet seat cover lifting means connected to said riser rod, said horizontal transition portion, and said horizontal extension portion, and second toilet seat cover lifting means connected to the toilet seat cover, a first hinge member connected to said horizontal transition portion, a second hinge member connected to said horizontal extension portion, a hook portion connected to said first hinge member and said second hinge member, a hook control member connected to said hook portion, and a hook actuator handle, supported by said riser rod, and connected to said hook control member.

2. The apparatus of claim 1 wherein:

said first toilet seat hinge means include strap hinges, and said second toilet seat hinge means include a hinge pin received in said strap hinges.

3. The apparatus of claim 2, further including:

a lock pin, connected to said hinge pin, for preventing said hinge pin from slipping out from said strap hinges.

4. The apparatus of claim 2, further including:

a horizontal transition portion connected between said hinge pin and said riser rod.

5. The apparatus of claim 1 wherein said hook control member is a stiff wire which is interconnected between said hook portion and said hook actuator handle.

6. The apparatus of claim 1 wherein said second toilet seat cover lifting means include:

a horizontally oriented hookable finger connected to the toilet seat cover.

* * * * *